US006036818A

United States Patent [19]

Ödmark

[11] Patent Number: 6,036,818

[45] Date of Patent: Mar. 14, 2000

[54] PULP-DEWATERING ROLL PRESS

[75] Inventor: Leif Ödmark, Matfors, Sweden

[73] Assignee: Sunds Defibrator Industries AB, Sweden

[21] Appl. No.: 09/077,659

[22] PCT Filed: Nov. 25, 1996

[86] PCT No.: PCT/SE96/01534

§ 371 Date: Jun. 8, 1998

§ 102(e) Date: Jun. 8, 1998

[87] PCT Pub. No.: WO97/21868

PCT Pub. Date: Jun. 19, 1997

[30] Foreign Application Priority Data

Dec. 8, 1995 [SE] Sweden ..... 9504400

[51] Int. Cl.[7] ..... D21D 1/00

[52] U.S. Cl. ..... 162/261; 162/272

[58] Field of Search ..... 162/261, 272, 162/380, 202

[56] References Cited

U.S. PATENT DOCUMENTS 1,322,489 11/1919 Howard ..... 162/261
3,261,741 7/1966 Bidwell ..... 162/261
3,772,144 11/1973 Luthi et al. .

FOREIGN PATENT DOCUMENTS

94/26388 11/1994 WIPO .

*Primary Examiner*—Christopher A. Fiorilla
*Attorney, Agent, or Firm*—Lerner, David, Littenberg, Krumholz & Mentlik, LLP

[57] ABSTRACT

Pulp-dewatering apparatus is disclosed including a pair of press rolls and a rotatable pulp disintegrating screw above the nip region between the press rolls, and the apparatus includes a pair of doctor bars associated with the pair of press rolls, each doctor bar including a doctor blade for removing pulp from the surface of its associated press roll, and in which one of the doctor blades is disposed adjacent to the nip region below the pulp disintegrating screw such that the space between the pair of press rolls and the pulp disintegrating screw in which a pulp cake can form is substantially reduced.

5 Claims, 3 Drawing Sheets

PULP-DEWATERING ROLL PRESS

FIELD OF THE INVENTION

The present invention relates to a pulp-dewatering roll press.

BACKGROUND OF THE INVENTION

One problem with roll presses resides in the uneven outfeed from the press. Many attempts have thus been made to rectify such outfeed pulsations, without successfully solving the problem, however. In this regard, attempts have been made to solve the problem by improving the disintegrating capacity of the pulp disintegrating screw, although without any great success. Instead, attention has been concentrated on the pulp cake that forms above the roll nip in the space between the rolls and the pulp disintegrating screw.

An object of the present invention is therefore to solve the aforesaid problem and to achieve an essentially even outfeed from the press.

SUMMARY OF THE INVENTION

These and other objects have now been achieved by the invention of pulp-dewatering apparatus comprising a pair of press rolls rotatably mounted adjacent to each other in order to provide a nip region therebetween, a rotatable pulp disintegrating screw rotatably disposed above the nip region, whereby pulp fed through the nip region is directed towards the pulp disintegrating screw to be further disintegrated and transported thereby, a first doctor bar associated with one of the pair of press rolls, a second doctor bar associated with the other of the pair of press rolls, the first doctor bar including a first doctor blade for removing pulp from the surface of the one of the pair of press rolls, and the second doctor bar including a second doctor blade for removing pulp from the surface of the other of the pair of press rolls, one of the first and second doctor blades being disposed adjacent to the nip region below the pulp disintegrating screw whereby the space between the pair of press rolls and the pulp disintegrating screw in which pulp cake can form is substantially reduced.

In accordance with one embodiment of the pulp-dewatering apparatus of the present invention, the pulp disintegrating screw includes a center of rotation, and the one of the first and second doctor blades is disposed at least partially below the center of rotation of the disintegrating screw.

In accordance with another embodiment of the pulp-dewatering apparatus of the present invention, the space between the pair of press rolls and pulp disintegrating screw has a predetermined configuration, and the one of the first and second doctor bars has a cross-sectional shape corresponding to the predetermined configuration whereby the doctor bar fills a substantial portion of the space.

In accordance with another embodiment of the pulp-dewatering apparatus of the present invention, the apparatus includes first and second seals disposed at opposite ends of the pair of press rolls for sealing the ends of the pair of press rolls, and the one of the first and second doctor bars is at least partially suspended from one of the first and second seals.

In accordance with another embodiment of the pulp-dewatering apparatus of the present invention, the apparatus includes first and second support beams for supporting the first and second doctor bars, and the one of the first and second doctor bars is supported by a corresponding one of the first and second support beams, and the apparatus includes a cover plate provided between the one of the first and second doctor bars and the corresponding one of the first and second support beams extending along the periphery of the pulp disintegrating screw whereby the space between the first and second pressure rolls and the pulp disintegrating screw for passage of the pulp is further reduced.

BRIEF DESCRIPTION OF THE DRAWINGS

The present invention can be more fully appreciated with reference to the following detailed description, which, in turn, refers to the drawings in which.

DETAILED DESCRIPTION

Figure 1:
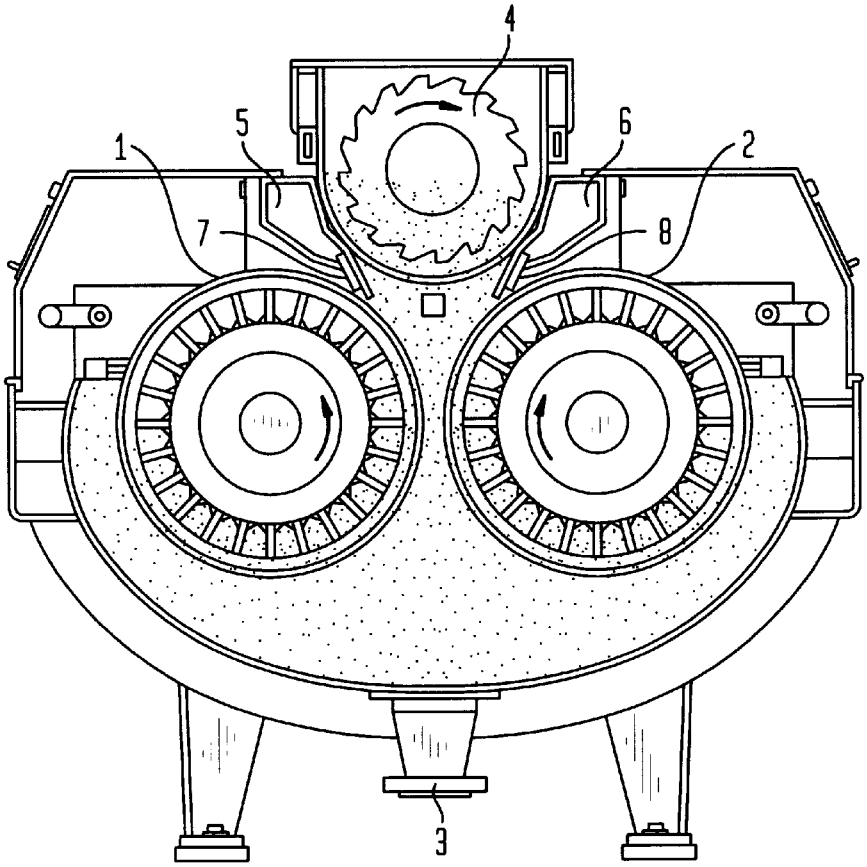
FIG. 1 is a side, cross-sectional view of a conventional roll press according to the prior art.

Referring to the Figures, in which like reference numerals refer to like elements thereof, a known press is shown in FIG. 1, and includes two rolls 1 and 2 whose mantle surfaces are perforated to allow water pressed from the pulp to pass through. The pulp is darkly colored in the Figure. The pulp is fed in through an inlet 3 and pressed up towards the nip defined between the two rolls, 1 and 2, where water is removed from the pulp and the pulp is pressed up towards a pulp disintegrating screw 4 that extends parallel with the press roll axes. The screw disintegrates the pulp and transports the pulp axially away from the press. Each roll, 1 and 2, is provided with a respective doctor bar, 5 and 6, and each bar is provided at the bottom thereof with a respective doctor blade, 7 and 8, for scraping the respective roll surfaces.

Figure 2:
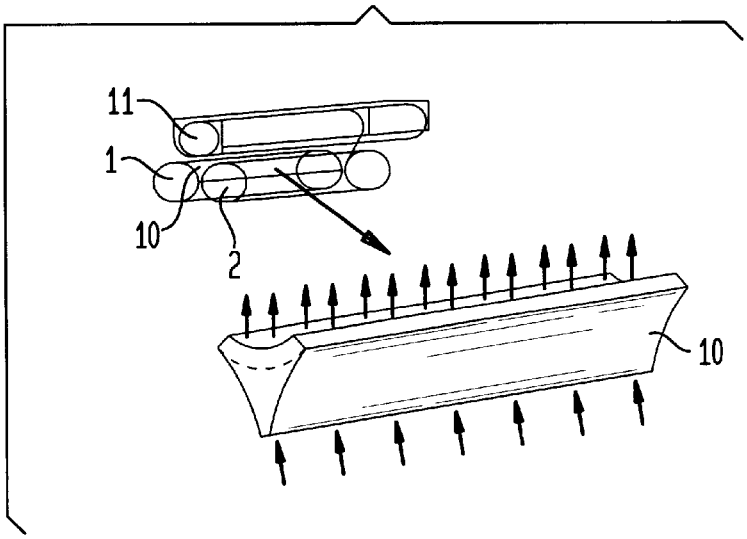
FIG. 2 is a schematic representation of the apparatus shown in FIG. 1 demonstrating the formation of a pulp cake therein.
Figure 3:
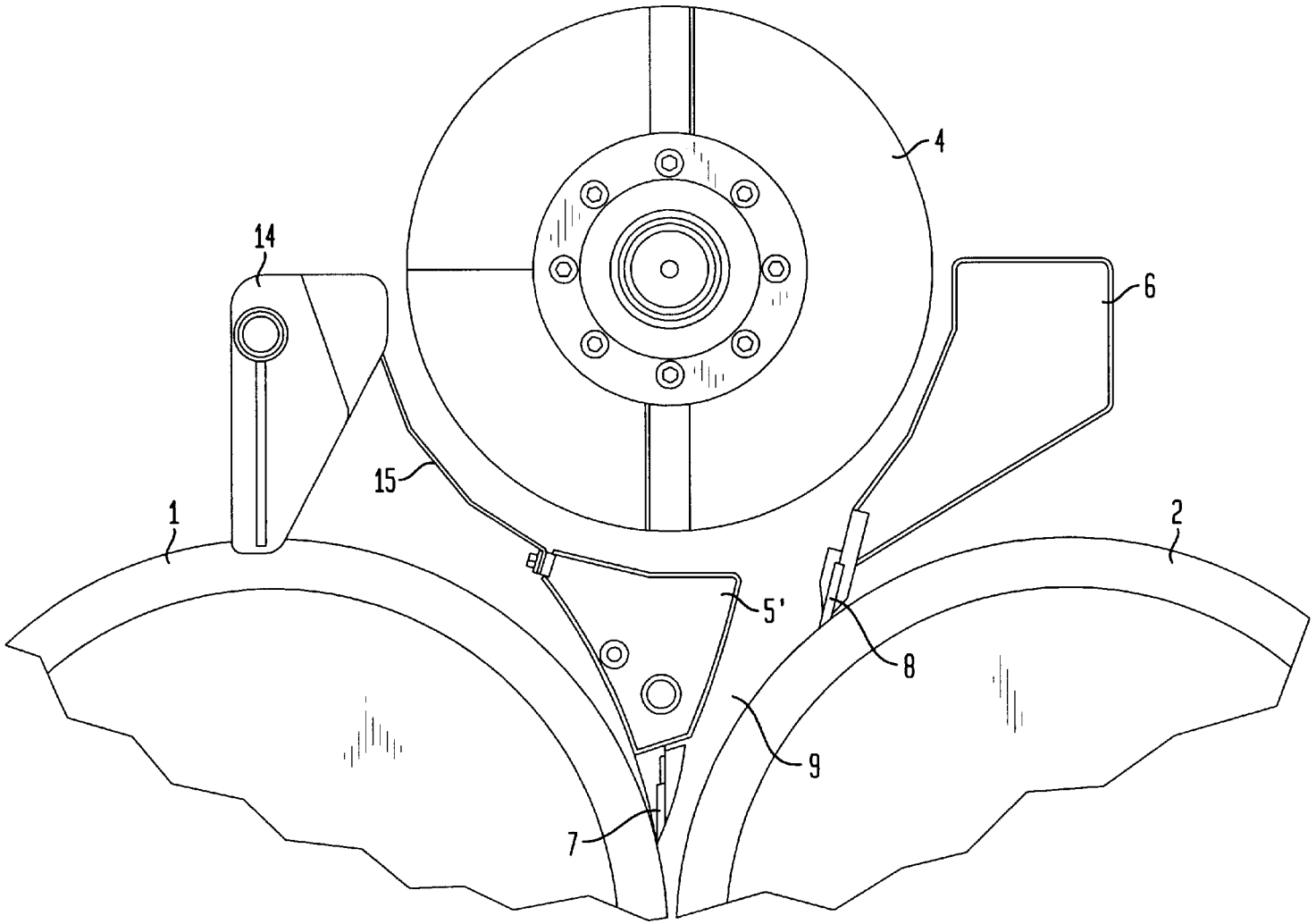
FIG. 3 is a partial, side, elevational view showing a doctor bar and associated support beam of the pulp-dewatering apparatus of the present invention.
Figure 4:
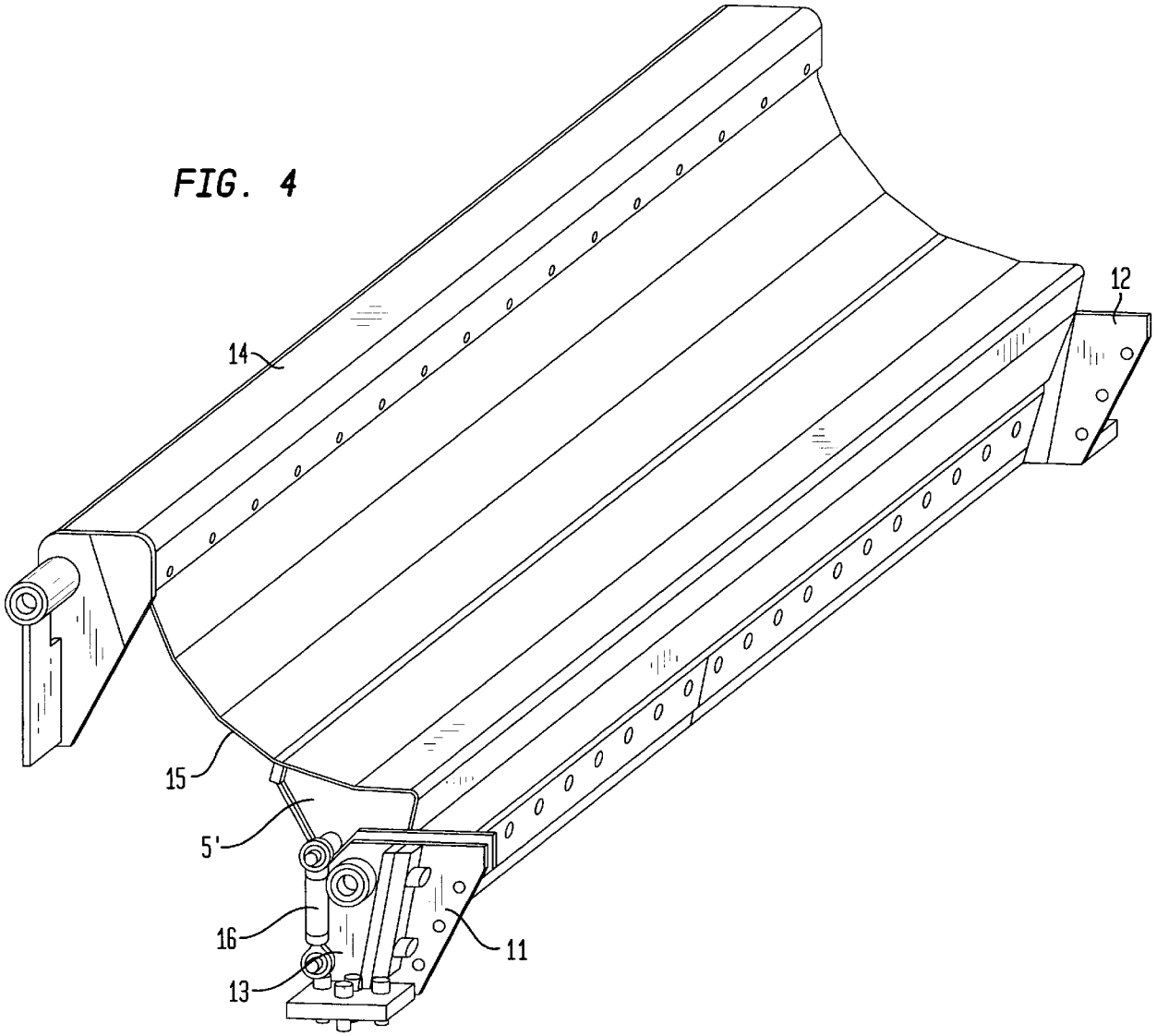
FIG. 4 is a front, perspective view of a doctor bar and associated support beam for use in the pulp-dewatering apparatus of the present invention.

The two rolls, 1 and 2, the screw 4 and the two doctor bars 5 and 6, together define above the roll nip a space 9 in which there is formed a pulp cake 10, as best seen from the respective view in FIG. 2. It has been found that the pulp cake makes guiding of the pulp web into the pulp disintegrating screw and subsequent smoothing of the outfeed from the press difficult to achieve.

This problem is solved in accordance with the present invention by reducing the volume of the pulp cake 10, i.e., by reducing the volume of the space 9 in which the pulp cake builds up. This is achieved in accordance with the present invention by moving one doctor blade, 5, to a new position 5' in the space between the rolls 1 and 2 and the screw 4. This reduction in the volume of the space 9 thus reduces the space in which the pulp can accumulate, thereby resulting in a shorter oscillating period with a smaller volume of pulp with each pulsation. This reduction in volume reduces the resistance in the region of contact between cake and screw, in that the pulp moves faster and stays for a shorter time in the disintegration zone. This facilitates the infeed of pulp to the screw, either by preventing packing tendencies.

Because the doctor bar 5' is positioned beneath the pulp disintegrating screw and because the whole of that bar is used to reduce the volume of that space, the doctor blade 7 will be located so close to the roll nip as to be able to deal with the pulp web while it is still intact. This arrangement enables the other roll 2 to be used to drive the pulp cake up towards the screw 4.

The problem of suspending the doctor bar 5' has been solved by using the holders 11 for seals 12 at the ends of the roll as doctor bar supports. Functions relating to support, adjustment to doctor bar settings, and sealing against the roll are therewith incorporated in one and same unit. The supportive function of the doctor bar 5 in the earlier known case is now taken over by a support beam 14. A cover plate 15 is provided between the doctor bar 5' and the support beam 14 and extends along the periphery of the screw 4. This cover plate thus delimits the pulp receiving space at the screw 4. The doctor bar 5' can be adjusted in relation to the roll surface by means of a bottle screw 16 at each end.

Serious fiber-transfer problems are experienced with the doctor bar 5 of the earlier known arrangement, in so much as the bar lifts away from the roll and allows fibers to pass through. This problem is eliminated by the novel doctor bar 5' hereof. Because there is practically no pulp buffer, no forces occur that force the bar 5' against the roll 1. The main purpose of the "doctor" blade 7 is now to guide and angle-off the pulp web instead of scraping pulp from the surface of the roll as in the typical prior art case.

In the earlier case, the pulp is disintegrated by the screw in the same region as the actual transportation. In the case of the novel roll press hereof, the pulp disintegration and pulp transportation functions are mutually separated and the pulp is now disintegrated against the novel doctor bar 5' and then transported out of the press thereby. This means that the pulp web, which remains intact right up to the disintegrating sequence, meets no resistance by already disintegrated pulp pieces transported by the screw. It has also been found that transportation is improved by virtue of the shorter stay time of the pulp in the screw disintegrator.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

I claim:

1. Pulp-dewatering apparatus comprising a pair of press rolls rotatably mounted adjacent to each other in order to provide a nip region therebetween, a rotatable pulp disintegrating screw rotatably disposed above said nip region, whereby pulp fed through said nip region is directed towards said pulp disintegrating screw to be further disintegrated and transported thereby, a first doctor bar associated with one of said pair of press rolls, a second doctor bar associated with the other of said pair of press rolls, said first doctor bar including a first doctor blade for removing pulp from the surface of said one of said pair of press rolls, and said second doctor bar including a second doctor blade for removing pulp from the surface of the other of said pair of press rolls, one of said first and second doctor blades being disposed adjacent to said nip region below said pulp disintegrating screw whereby the space between said pair of press rolls and said pulp disintegrating screw in which a pulp cake can form is substantially reduced.

2. The pulp-dewatering apparatus of claim 1 wherein said pulp disintegrating screw includes a center of rotation, and wherein said one of said first and second doctor blades is disposed at least partially below said center of rotation of said disintegrating screw.

3. The pulp-dewatering apparatus of claim 1 wherein the space between said pair of press rolls and said pulp disintegrating screw has a predetermined configuration, and wherein said one of said first and second doctor bars has a cross-sectional shape corresponding to said predetermined configuration whereby said doctor bar fills a substantial portion of said space.

4. The pulp-dewatering apparatus of claim 1 including first and second seals disposed at opposite ends of said pair of press rolls for sealing the ends of said pair of press rolls, and wherein said one of said first and second doctor bars is at least partially suspended from one of said first and second seals.

5. The pulp-dewatering apparatus of claim 1 including first and second support beams for supporting said first and second doctor bars, wherein said one of said first and second doctor bars is supported by a corresponding one of said first and second support beams, and including a cover plate provided between said one of said first and second doctor bars and said corresponding one of said first and second support beams extending along the periphery of said pulp integrating screw whereby said space between said first and second pressure rolls and said pulp disintegrating screw for passage of said pulp is further reduced.

* * * * *

UNITED STATES PATENT AND TRADEMARK OFFICE

CERTIFICATE OF CORRECTION

PATENT NO. : 6,036,818

DATED : March 14, 2000

INVENTOR(S) : Odmark

It is certified that error appears in the above-indentified patent and that said Letters Patent is hereby corrected as shown below:

Col. 2, line 62, delete "either."

Signed and Sealed this

Twentieth Day of March, 2001

Nicholas P. Godici

*Attest:*

NICHOLAS P. GODICI

*Attesting Officer*

*Acting Director of the United States Patent and Trademark Office*